United States Patent [19]

Akaishi

[11] Patent Number: 5,000,229

[45] Date of Patent: Mar. 19, 1991

[54] COUPLER BETWEEN HEALD FRAME AND SHEDDING MECHANISM

[75] Inventor: Mitsuo Akaishi, Osaka, Japan

[73] Assignee: Nankai Kogyo Kabushiki Kaisha, Osaka, Japan

[21] Appl. No.: 461,218

[22] Filed: Jan. 5, 1990

[30] Foreign Application Priority Data

Jan. 13, 1989 [JP] Japan ..... 1-2848

[51] Int. Cl.[5] ..... D03C 9/00

[52] U.S. Cl. ..... 139/88; 24/637

[58] Field of Search ..... 24/637, 644; 139/88, 139/82–87, 89–91

[56] References Cited

U.S. PATENT DOCUMENTS 3,521,333 7/1970 Dunster ..... 24/637
4,365,653 12/1982 Freisler et al. ..... 139/88
4,715,409 12/1987 Graf ..... 139/88

FOREIGN PATENT DOCUMENTS 5434061 10/1979 Japan .
191483 11/1986 Japan .

*Primary Examiner*—Andrew M. Falik
*Attorney, Agent, or Firm*—Browdy and Neimark

[57] ABSTRACT

A coupler for coupling a detachable coupling between the edge of a frame stave of a heald frame and the distal end of a connecting rod of a shedding mechanism. Either the lower or upper edge of the frame stave is fixedly mounted to a body of the coupler which is in turn interlocked to the distal end of the connecting rod. The outer surface of the connecting rod interlock is retained by a clamp mounted on the body so that the connecting rod is prevented from moving outward from the body. The clamp is also provided with a manipulator lever which actuates the clamp for opening and closing motion.

4 Claims, 1 Drawing Sheet

COUPLER BETWEEN HEALD FRAME AND SHEDDING MECHANISM

FIELD OF THE INVENTION

The present invention relates to a coupler provided between a heald frame and a shedding mechanism in a loom and more particularly, a coupler for coupling between either the upper or lower edge of a heald frame and the distal end of a connecting rod of a shedding mechanism.

BACKGROUND OF THE INVENTION

A heald frame consists of frame staves forming upper and lower frameworks and side stays forming left and right frameworks and is provided with a number of healds, each heald having a warp accepted therethrough. The heald frame, as required for upward and downward reciprocating motion, is coupled at the lower or upper end to connecting rods of a shedding mechanism. The shedding mechanism comprises cam assemblies and crank assemblies and its movement is transmitted via the connecting rods to the heald frame which in turn travels upward and downward.

The selection of a heald frame corresponds to the type of weaving needed. A change of weaving thus involves the replacement of a heald frame, causing frequent attaching and detaching of couplers between the heald frame and the connecting rod. Also, each coupler is located inward in a loom, offering only a small space for attaching and detaching of the same. To make matters worse, a known coupler is rather awkward in the application of attachment and may cause loose lockup at the joint.

SUMMARY OF THE INVENTION

It is an object of the present invention to provide a coupler for ready attaching and detaching to couple between a heald frame and a connecting rod of a shedding mechanism, thereby improving the handling of the heald frame during replacement.

It is another object of the present invention to provide a coupler adapted for eliminating a state of non complete lockup at the joint to prevent inadvertent disengagement of the joint during operation and for visually determining whether the joint is securely engaged or disengaged whereby coupling failure is avoided.

It is a further object of the present invention to provide a coupler adapted for enhancing tightness in coupling to prevent any looseness at the joint during operation.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which.

DESCRIPTION OF THE PREFERRED EMBODIMENTS

Figure 1:
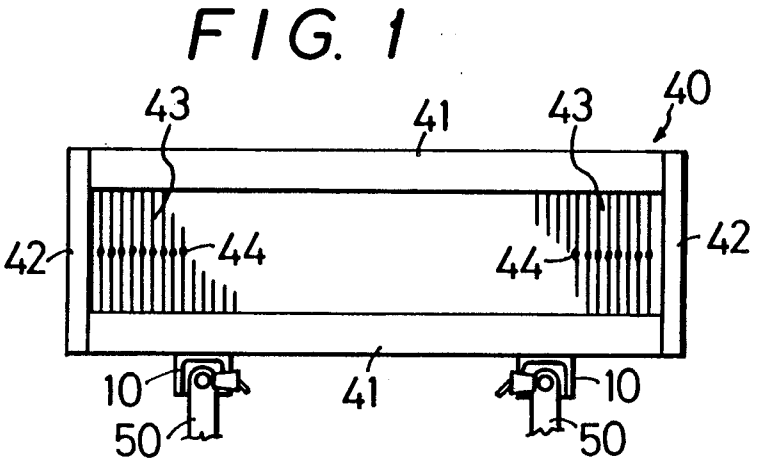
FIG. 1 is a front view showing the coupling between a heald frame and connecting rods of a shedding mechanism with couplers according to the present invention.

FIG. 1 illustrates the coupling between a heald frame 40 and connecting rods 50 with couplers 10 of the present invention. The heald frame 40 comprises a pair of frame staves 41 forming upper and lower frameworks and a pair of side stays 42 forming left and right frameworks. The heald frame 40 is provided with a number of healds 43 mounted thereon. Each heald 43 has a center opening 44 through which a warp is extended.

As shown in FIG. 1, disclosed is only the distal end of the connecting rod 50 while its proximal end and a shedding mechanism are not illustrated. The shedding mechanism includes any of available actuating means such as a cam drive or a crank drive in general. When the shedding mechanism is actuated, the connecting rods 50 perform upward and downward reciprocating motion. According to the embodiment of FIG. 1, there are provided left and right connecting rods 50 which may be altered to such a desired number as required, e.g., more than three. Even if more than two connecting rods 50 are provided, the shedding mechanism is commonly of a single unit which actuates all the connecting rods 50 at once. Although the connecting rods 50 are coupled to the lowermost end of the heald 40 according to the embodiment of FIG. 1, they may be joined to the upper end of the same.

Figure 2:
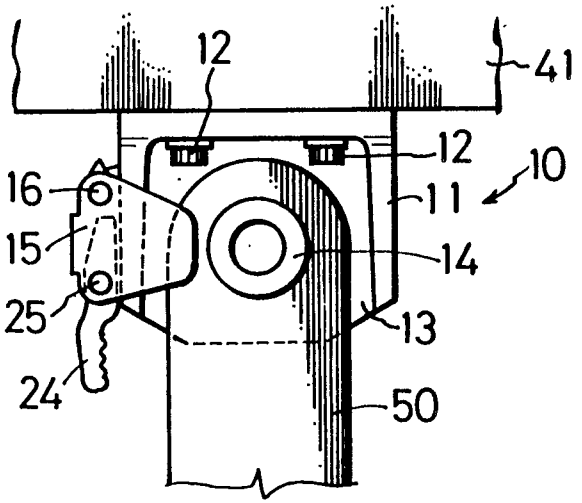
FIG. 2 is an enlarged front view showing the coupling between a heald frame and a connecting rod with the use of a preferred embodiment of the present invention in the form of a coupler.

FIG. 2 illustrates, in enlarged fashion, the arrangement of a joint in which a body 11, of the coupler 10, is mounted by bolts 12 to the lowermost end 45 of the frame staves 41. The body 11 has a recess 13 formed in one end thereof and is provided with a boss 14 of circular shape in the center. The boss 14 is fitted into an opening 51 formed in the distal end of the connecting rod 50. The thickness of the distal end of the connecting rod 50, the depth of the recess 13 in the body 11, and the extension of the boss 14 are all the same in measurement. Accordingly, when the boss 14 is engaged with the connecting rod 50, the outer surface of the body 11 becomes flush with the outer surface of the connecting rod 50.

Figure 3:
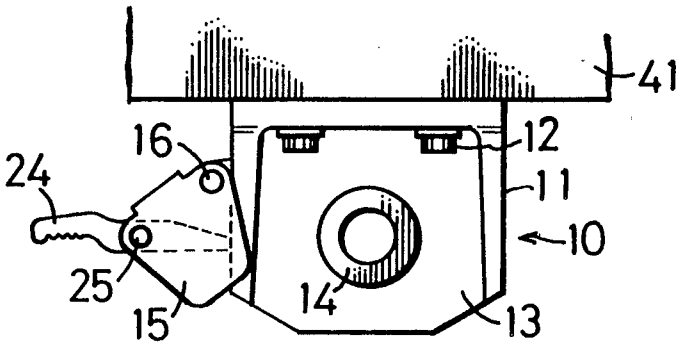
FIG. 3 is a front view, similar to FIG. 2, showing the connecting rod outwardly removed.
Figure 4:
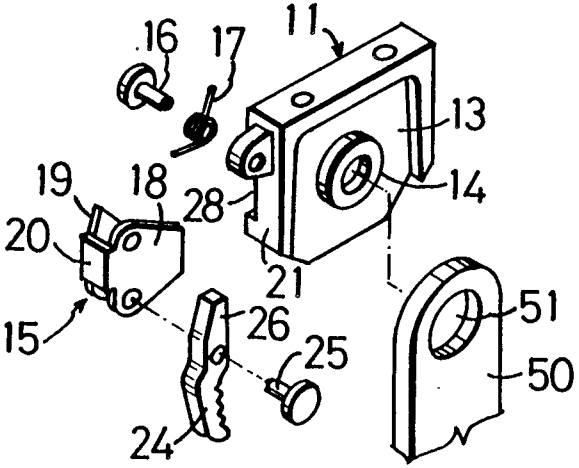
FIG. 4 is a perspective view showing an exploded arrangement of the coupler of FIG. 2.
Figure 5:
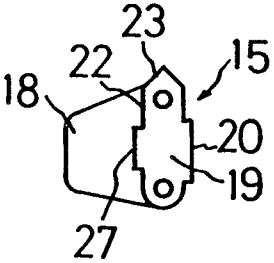
FIG. 5 is a rear view of a clamp.

A clamp 15 is pivotably mounted to the body 11 with a pin 16 so that the clamp 15 can move from its closed position shown in FIG. 2 to its open position shown in FIG. 3. The pin 16 incorporates a spring 17 thereon which urges the clamp 15 to the closed position. The clamp 15 comprises a front plate 18, a rear plate 19, and a connector plate 20. When the clamp 15 is at the closing position, the front plate 18 engages with the outer surface of the connecting rod 50 thus preventing the connecting rod 50 from being dislocated. The rear plate 19 acts as a stopper for positioning and, more particularly, holds the clamp 15 at the closed position when its edge 22 has come into contact with a side end 21 of the body 11 and at the open position when in contact with its other edge 23.

A manipulator lever 24 is pivotably mounted to the clamp 15 by a pin 25 for finger operation by an operator. When the lever 24 is actuated, its foot end 26 comes into contact with the side end 21 of the body 11. As the result of counter-action, the clamp 15 shifts to the open position. When the lever 24 is fully turned to where its rear end comes into contact with the edge of the connector plate 20 until no further movement is allowed, the clamp 15 becomes set at its maximum open position. At the same time, the edge 23 of the rear plate 19 also comes into contact with the side end 21 of the body 11 whereby the clamp 15 is permitted no further turning. Simultaneously, the connecting rod 50 remains disengaged from the front plate 18 while ensuring the opening of the clamp 15. The clamp 15, which is urged by the spring 17 to the closed position, can be held at the open position because the foot 26 of the lever 24 acts to retain the maximum open position. However, when the lever 24 is slightly actuated to the return direction, no stop action of the foot 26 is effected and thus the clamp 15 will return to the closed position. Specifically, the clamp 15 can be locked out only at the maximum open position but at no intermediate position.

The manipulator lever 24 can be turned through about 90° between the open and closed positions. and not allowed to rest at any intermediate position as well as clamp 15 which stops at no intermediate position It is thus facilitated to visually examine whether the clamp 15 is set at the open or closed position since the two positions are spaced about 90° apart and fault lockup of the clamp 15 will be avoided. Also, when the lever 24 is painted in a different color from the other components, its position will be identified more apparently.

When the clamp 15 is positioned in the closing with the edge 22 of its rear plate 19 having come into contact with the side end 21 of the body Il, a projection 27 provided on the edge 22 fits into a notch 28 provided in the side end 21. Accordingly, the clamp 15 is closely kept in the closed position and not allowed to turn by itself for opening motion.

It is understood that the above description concerns one of many feasible embodiments of the present invention and many structural changes of the clamp 15 or configurational changes of the manipulator lever 24 are possible.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended with the meaning and range of equivalents of the disclosed embodiments. It is to be understood that the phraseology or terminology employed herein is for the purpose of description and not of limitation.

I claim:

1. A coupler between a heald frame and a shedding mechanism comprising:

a body having means for securing to an edge of the heald frame and means for interlocking to a connecting rod;

a clamp pivotably mounted to said body and yieldingly urged by a spring to a closed position; and a manipulator lever pivotably mounted to said clamp, said clamp having means for effecting lockup of the connecting rod coupled to said body and to maintain the lockup and, when said manipulator lever is actuated to move by pressing until a foot of said lever comes into contact with a side end of said body, thereby turning back said clamp to an open position, said manipulator lever having means for holding said clamp at a maximum open position with sad foot thereof acting as a stopper so that said body can be engaged with the connecting rod.

2. A coupler as defined in claim 1, wherein said body is provided with a boss adapted to fit into an opening provided in the connecting rod of which an outer surface is engaged with said clamp when coupled.

3. A coupler as defined in claim 1, wherein said clamp comprises a front plate and a rear plate, said front plate including means for engagement with the connecting rod at the closed position while said rear plate being capable of alternative positioning between the open and closed positions with an edge of said rear plate made to contact with the side end of said body.

4. A coupler as defined in claim 3, wherein said rear plate of said clamp has a projection formed on the edge thereof for fitting into a notch provided in the side end of said body when said clamp is at the closed position.

* * * * *